United States Patent [19]

Simich

[11] 4,438,689

[45] Mar. 27, 1984

[54] MATERIAL BALING DEVICE

[75] Inventor: Emil Simich, Chicago, Ill.

[73] Assignee: A. J. Gerrard & Co., Des Plaines, Ill.

[21] Appl. No.: 376,266

[22] Filed: May 10, 1982

[51] Int. Cl.[3] ..... B65B 13/04

[52] U.S. Cl. ..... 100/25; 100/3

[58] Field of Search ..... 100/3, 25, 26; 226/181

[56] References Cited

U.S. PATENT DOCUMENTS

| | | | |
|---|---|---|---|
| 2,732,792 | 1/1956 | White | 100/25 |
| 3,213,780 | 10/1965 | Neitzel | 100/26 X |
| 3,220,337 | 11/1965 | Goland | 100/26 X |
| 3,279,354 | 10/1966 | Dickens | 100/26 |
| 3,288,337 | 11/1966 | Van Bergen | 226/181 |
| 3,525,192 | 8/1970 | Merkel | 100/25 X |

FOREIGN PATENT DOCUMENTS

| | | | |
|---|---|---|---|
| 2257567 | 5/1974 | Fed. Rep. of Germany | 100/3 |

*Primary Examiner*—Billy J. Wilhite

*Attorney, Agent, or Firm*—Emrich, Lee, Brown & Hill

[57] ABSTRACT

A baling apparatus for use with bale tie wire and a press including a pair of platens having at least one channel extending fore-and-aft across each platen. The baling apparatus comprises a return chute supported on a frame in juxtaposition to the pair of platens. The chute has a curved face and two sidewalls extending radially inward from the outer edges of the curved face. The chute is adapted to be aligned with the channels of each platen to slideably receive bale tie wire extending through the channel of one platen and directing the wire as it travels along the curved face into and through the channels of the opposite platen wherein both ends of the bale strapping wire will be protruding from the same side of a press and can be manually secured onto itself. A plurality of bale tie wires can be simultaneously threaded around a bale form by means of a plurality of chutes and a power feed assembly. The power feed assembly is adopted to engage, power and guide the bale tie wire into and through the channels of the platens and through the return chute assembly.

8 Claims, 5 Drawing Figures

45
38a
38b
38b
30
45
35
45
32
45
43
43
40
44
44
36a
36b
36c
36d
36e
34b
36f
34a
31
39
45
45
45
45
45
45
45
45
32
45
43
32
45
45
45
45
45
45

15a
73a
66
73
60a
65
60b
60c
60d
60e
60f
66
11
36a
44
36b
36c
36d
36e
36f
44
24
31
45
45
45
45
45
45
45
17
18
16
15b

MATERIAL BALING DEVICE

BACKGROUND OF THE INVENTION

The present invention relates generally to bale forming devices and, more specifically, to a device for use in wrapping strapping material around the girth of a bale.

For numerous applications, bale tie wires are considered to be the strapping material of choice for reasons of economy. Typically, the bale tie wires are applied manually about the girth of the pressed material forming the bale in an operation requiring at least two press operators. Wires are first manually inserted over the top of the pressed material through channels in the upper platen by one of two press operators. The second press operator on the opposite side of the press, would grasp the leading end of the bale tie wire as it protruded from the opposite side of the platen channel and would then redirect and insert the wire in a channel of the lower platen, beneath the pressed material, and push the wire forward through the lower channel. The first press operator would receive the end of the lower bale tie wire as it protruded through the channel of the lower platen. The first operator would then secure the end of the bale wire left protruding from the upper platen channel with the end now protruding from the lower platen onto each other to form a joint on the front side of the pressed material. Bales are usually secured by a number of bale tie wires; thus, the manual operation would be repeated numerous times for just one bale.

The standard method of forming bales, requiring two operators manually handling the strapping materials, is not efficient in its utilization of manpower or time. Due to inherently high labor costs considerable interest has been generated in eliminating unnecessary personnel and reducing the time needed to bale materials.

SUMMARY OF THE INVENTION

The present invention facilitates the baling of resilient materials by means of a semicircular chute which receives strapping material threaded through a channel of one of two platens and redirects the strapping material into and through a channel of the opposite platen. Thus, both ends of the strapping material are localized within easy reach of a single operator.

A further embodiment of the invention provides for the power feeding of any number of bale tie wires simultaneously around the girth of a bale formed in a press. The simultaneous threading of multiple units of bale strapping material reduces the threading time while reducing manpower requirements in half and consequently increases the efficiency of the entire baling process. Further, the use of a power feed system facilitates the use of remote controls allowing the press operator to stand away from the press equipment during greater periods of time while the press is in operation thereby promoting a reduction in worker accidents.

Briefly, an embodiment of the present invention includes a return chute assembly for use with bale strapping material, particularly bale tie wire, and a press, including a pair of platens having at least one channel extending for and aft across each platen. The return chute assembly includes at least one chute supported on a frame in juxtaposition to the pair of platens. The chute has a curved face and two sidewalls. The curved face extends radially outward from the press above and below the platens in a press or compaction position. The sidewalls extend radially inward from the outer edges of the curved face forming a passage for strapping material. The chute is adapted to be aligned in communication with the channels of each platen to slideably receive strapping material extending through the channel of one platen and directing the strapping material as it travels along the curved face into and through the channel of the opposite platen wherein both ends of the bale strapping wire will be protruding from the same side of a press and can be secured onto itself to form a bale.

To further facilitate the baling process, a further embodiment of the invention includes a power feed assembly. The power feed assembly includes two crown wheels mounted in line on a power feed assembly frame. Each crown wheel has a middle surface extending about the circumference of each wheel and two outer ridges projecting radially outward from the outer edges of the middle surface. An idler wheel, mounted to the power feed assembly frame, is interposed between the two wheels in cooperating relationship to define a path for strapping material. The feed assembly frame supports the crown wheels and idler wheels in juxtaposition to the press platens opposite the return chute assembly. The feed assembly frame is adapted to hold the crown wheels and idler wheel of the feed assembly such that the path of the strapping material is aligned with a channel of one of the platens. At least one of the wheels is coupled to a power source to allow the idler wheel and wheels to engage the tie wire and move the tie wire into and through the channel which it is aligned with, through the return chute assembly and through the channel of the other platen. Bale strapping material is mechanically threaded around the platen such that both ends of the strapping material project from one face of the pressed bale. These ends of bale tie wire can be simply joined by a single operator, completing the baling process.

Bales are often formed with a plurality of straps or bale tie wires securing the bale form. An embodiment of the present invention includes the use of a plurality of power feed assemblies and a plurality of chutes in the return chute assembly to allow the simultaneous threading of a plurality of wires or units of strapping material around the baled form. The power feed assemblies can be activated remotely further increasing the efficiency of the bale tie threading procedure and promoting operator safety.

A further embodiment of the present invention includes a frame having at least one member extending parallel to the platens. The frame member has portions which are threaded for receiving nuts. At least one chute is received on the frame member and releasably secured by nuts threadably received on the frame member on each side of the chute allowing the wire chute to be moved along the length of the member. Thus, the present invention is readily adaptable to existing equipment without extensive modification due to the ability of the return chute assembly to accommodate differing shaped platens simply by shifting the position of the chutes.

Other features and advantages of the present invention will be apparent from the following description and claims and are illustrated in the accompanying drawings which, by way of illustration, show preferred embodiments of the present invention, the principles thereof and what is now considered to be the best mode in which to apply these principles. Other embodiments of the invention incorporating the same or equivalent principles may be used and structural changes may be made as desired to those skilled in the art without departing from the present invention and the purview of the appended claims.

DETAILED DESCRIPTION

The present invention will be described in detail with the understanding that the disclosure is to be considered an exemplification of the principles of invention and is not intended to limit the embodiment illustrated.

Figure 1:
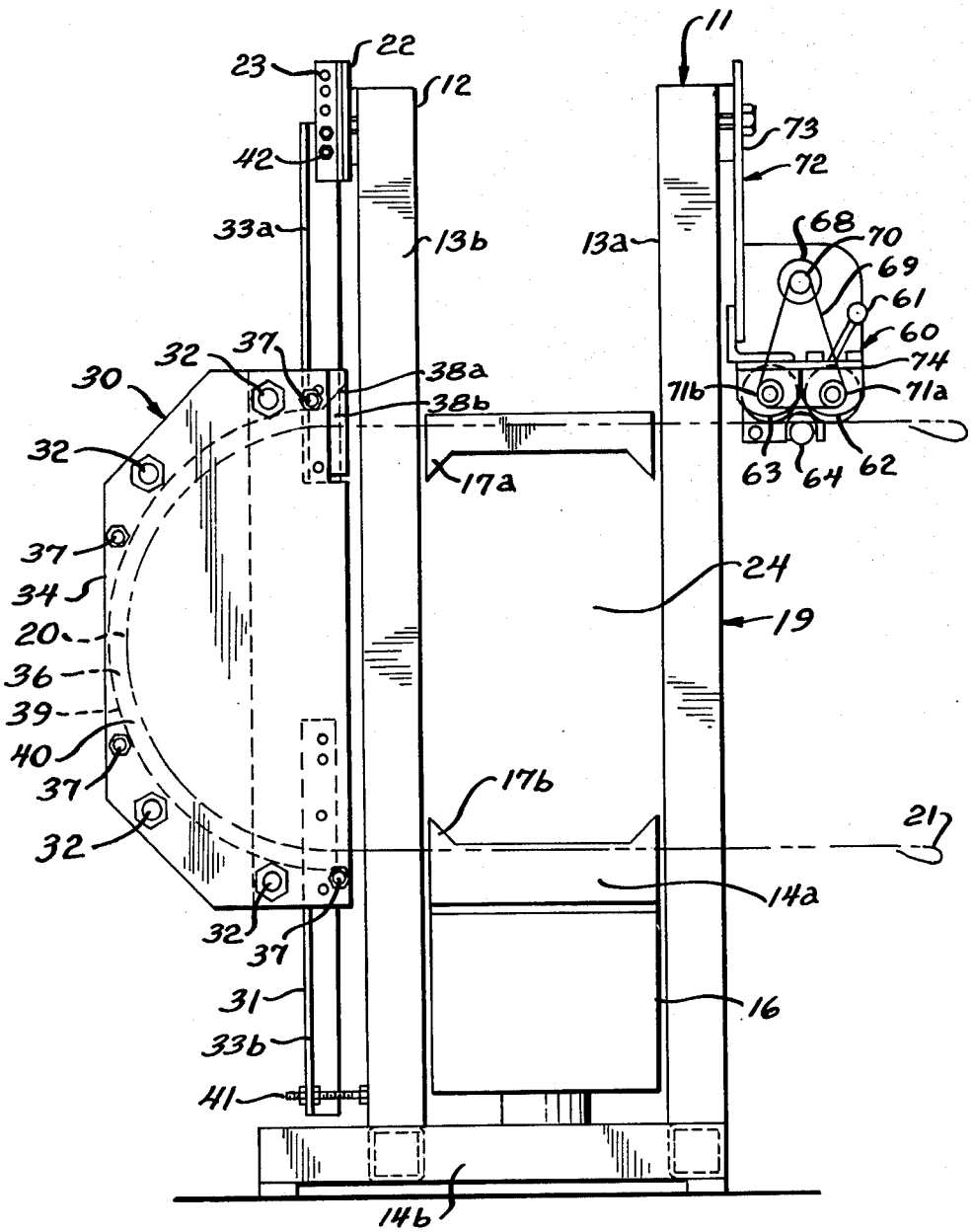
FIG. 1 is a side perspective view of bale forming apparatus embodying the principles of the present invention.

The baling device of the subject invention, generally designated by number 11, is best seen in FIG. 1 is comprised of the following major elements: a press assembly 19, a return chute assembly 30, and a power feed assembly 60.

Figure 5:
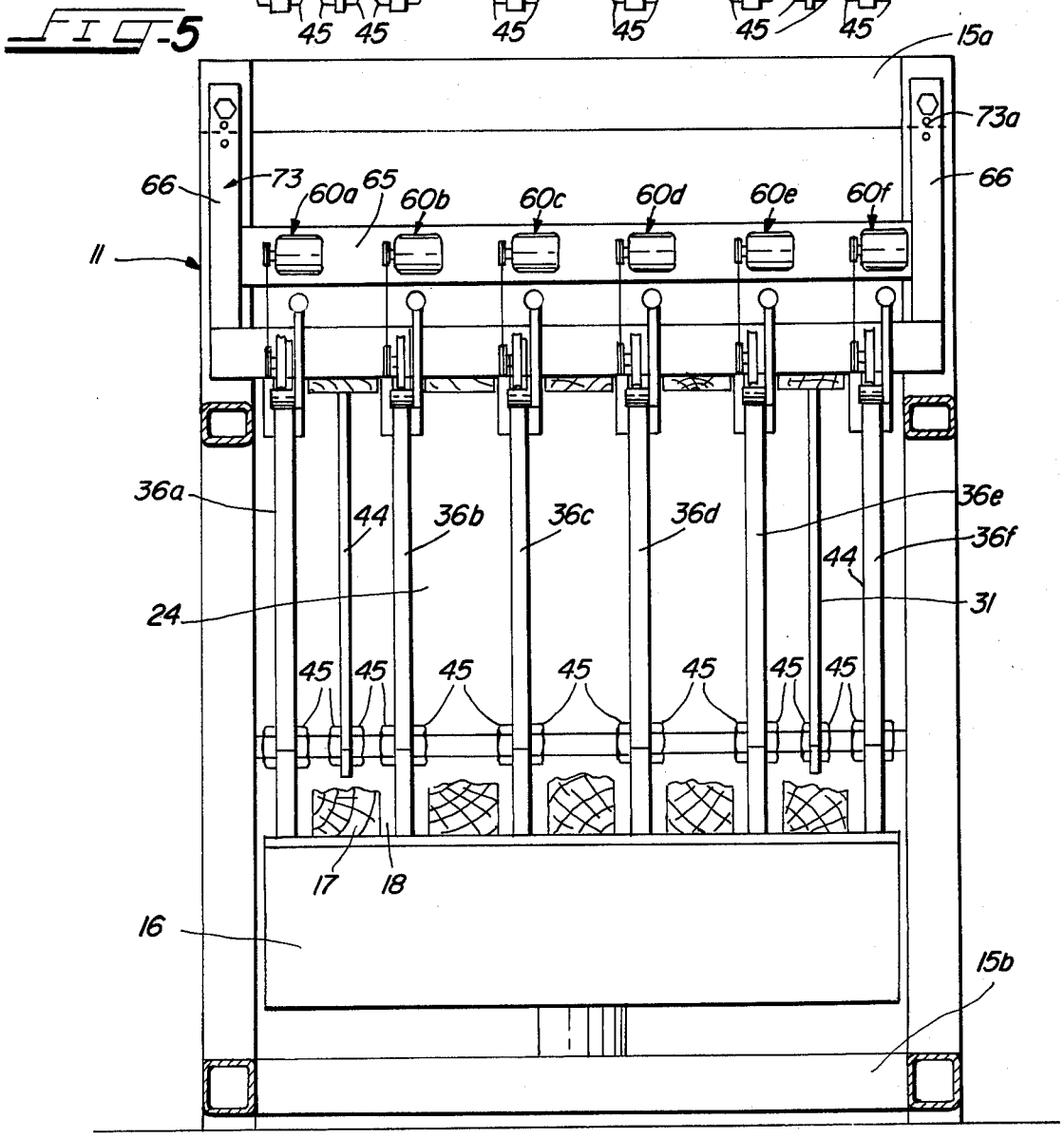
FIG. 5 is a front perspective view of a bale forming device, embodying principles of the present invention having a plurality of power feed units.

The press assembly 19 is itself comprised of the following elements: a frame 12 including front and rear vertical members 13*a* and 13*b* and horizontal members 14*a* and 14*b*, a hydraulic press 16, and as can best be seen in FIG. 5, platens 17*a* and 17*b*. The lower platen 17*b* is secured to the hydraulic press to allow upward movement to compact resilient material (not shown) against the upper platen 17*a* into a bale form. Each platen 17*a* and 17*b*has channels 18*a* and 18*b* respctively to allow the wrapping of bale strapping material around the girth of the bale form.

In the past, two operators were required to operate a bale press and strap the compress material. Referring now to FIG. 1, resilient material from which the bale would be formed would be collected in the space generally designated as 24. After the material was accumulated the press operator would activate the hydraulic press 16, compacting the materials between the upper and lower platens 17*a* and 17*b*. One of the two operators, standing to one side of the press assembly 19 would insert bale strapping material, such as bale tie wire 21, through a channel 18*a* of one of the platens 17*a*, best seen in FIG. 5. The bale tie wires 21 was inserted until it protruded from the opposite side of the press assembly 19 where the second operator would grasp the protruding tie wire 21, extend the tie wire 21 outward, and redirect an insert the wire 21 into a channel 18*b* of the opposite plate 17*b*. The tie wire 21 was then forced through the opposite channel 18*b* until both ends of the tie wire protruded from the same face of the press assembly 19. The first operator would then grasp the remaining bale tie wire 21 protruding from the uppermost channel 18*a* and the protruding bale tie wire from the lower channel 18*b* and join the ends of the bale tie wire to form a secure knot or joint. Normally, the bale is secured by a plurality of baled tie wires such that the time necessary to bind the bale material can be substantial.

Figure 2:
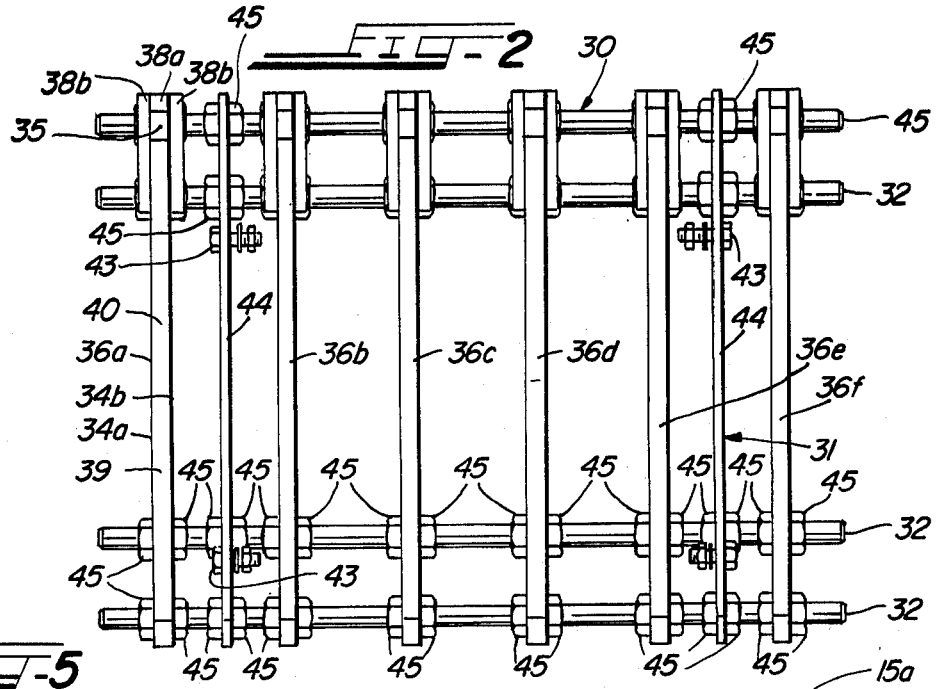
FIG. 2 is a front perspective view of a return chute assembly incorporating the present invention having a plurality of guides or chutes.

Referring again to FIG. 1, the return chute assembly 30 obviates the need for a second press operator by providing a means for mechanically directing the bale strapping material from the channel of one platen to the channel of another platen without further manual interference. The return chute assembly 30 includes a frame 31 including upper and lower vertical members 33*a* and 33*b* respectively, horizontal members in the form of tie rods, 32, and support plates 44, which can best be seen in FIG. 2. The support plates 44 are secured to vertical members 33*a* and 33*b* by means of bolts 43. The support plates have holes for receiving tie rods 32. As illustrated in FIGS. 1 and 2, tie rods 32 have threaded portions which receive nuts 45. Support plates 44 are straddled between nuts 45 on tie rod 32 allowing the plates to be shifted from one horizontal position to another along the length of the tie rod by adjusting the placement of the nuts 45.

Referring now to FIG. 1, the return chute assembly further includes at least one chute 36 comprised of a left and right plate 34*a* and 34*b* and a curved wall 39. Curved wall 39 is held between plates 34*a* and 34*b* by means of washer-like spacers 35 welded to the curved wall 39 and secured to the plates 34*a* and 34*b* by means of bolts 37. Each bolt 37 extends through a plate 34*a*, through spacer 35, and through the remaining plate 34*b* where it is secured by a nut. Curved wall 39 extends radially outward from the press assembly 19 from above and below the channels 18*a* and 18*b* of the platens 17*a* and 17*b* when the platens 17*a* and 17*b* are in the compacting position. The two plates 34*a* and 34*b* form sidewalls extending radially inward from the outer edges of the curved face forming a passage 40 for strapping material such as tie wire 21. The chute 36 is adopted to be aligned in communication with the channels 18*a* and *b* of each platen 17*a* and 17*b* to slideably receive tire wire 21 extending through the channel 18*a* of one platen 17*a* and direct the tie wire 21 as it travels along the curved face 39 into and through the channel 18*b* of the opposite platen 17*b*, where both ends of the wire 21 can be secured onto itself to form a joint (not shown). Plates 34*a* and 34*b* extend radially outward from the plate and are fitted with holes for receiving tie rod 32 to mount the chute 36 to chute assembly frame 31.

The uppermost section of the curved wall 39 includes a vertical flared section 38*a* extending above the channel 18*a*. In like manner, the upper areas of plates 34*a* and 34*b* include a flared portion extending 38*b* laterally outward beyond the opening of channel 18*a*. The flared portions 38*a* and 38*b* of the chute 36 funnel tie wires into the passage 40 and further allow a greater degree of variability in the alignment of chute 36 with channels 18*a* 18*b*.

The return chute assembly is supported in juxtaposition to the press assembly 19 by means of the return chute frame 31 such that the outwardly flared portions 38*a* and 38*b* communicate with the channels 18*a* of the upper platen 17*a* and the bottom of chute 36 communicates with the channels 18*b* of the lower platen 17*b* during the press or compaction period. Referring now to FIGS. 1 and 5, the return chute assembly is held in juxtaposition to the press assembly 19 by means of vertical brackets 22. Vertical bracket 22 is equipped with several holes 23 which allow the return chute assembly to be pivotally suspended by pivot bolt 42 at varying vertical orientations. Bolt 41 provides an extendible abutment surface to adjust the spacing between the return chute assembly and the press frame 12.

Normally, a plurality of bale tie wires are used to retain the bale form. FIG. 2 depicts a return chute assembly 30 equipped with a plurality of chutes 36*a–f* mounted upon tie rods 32. Each chute 36 is comprised of a left and right vertical plate 34*a* and 34*b* and a curved wall 39 defining a passage 40 for bale strapping material. Each chute 36 is further received on the tie rod by means of holes extending through a portion of the vertical plates 34 extending radially outward from the curved face 39. Each chute 36 can be secured at varying positions along the horizontal length of the tie rod 32 by shifting the position of securing nuts 45 threadably received on the tie rod 32.

Referring now to FIG. 1, a power feed assembly, generally designated by numeral 60, is shown mounted on vertical member 13*a* by means of a brace 73. Brace 73, as can best be seen in FIG. 5, is equipped with several vertically aligned holes 73*a* to allow the power feed assembly to be mounted at various vertical positions to accommodate differing press assemblies 19.

Figure 3:
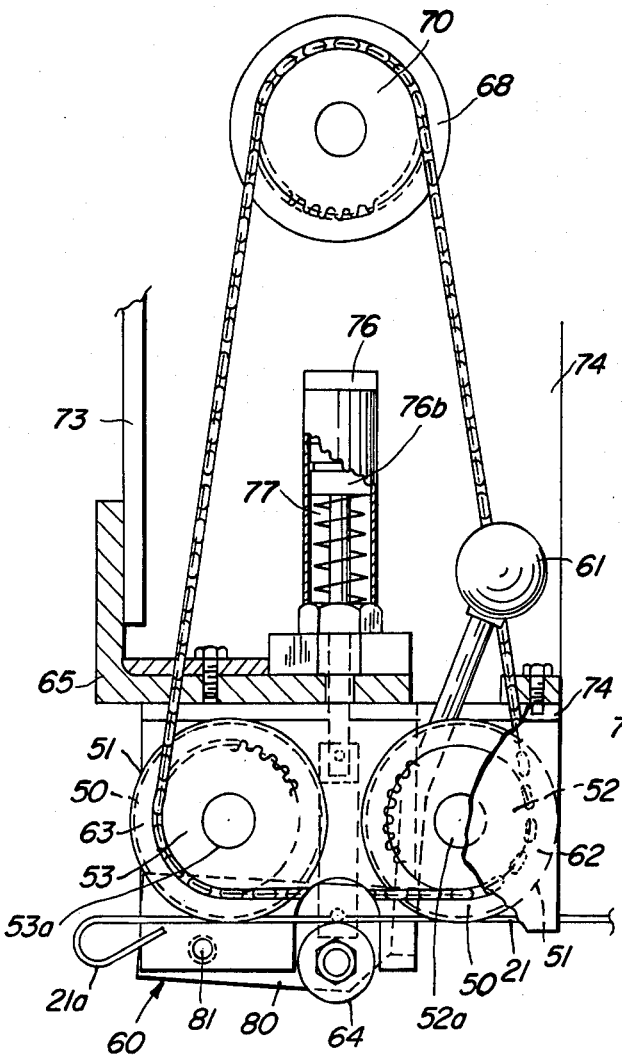
FIG. 3 is a sectional side perspective view of a power feed assembly embodying the principles of the present invention.
Figure 4:
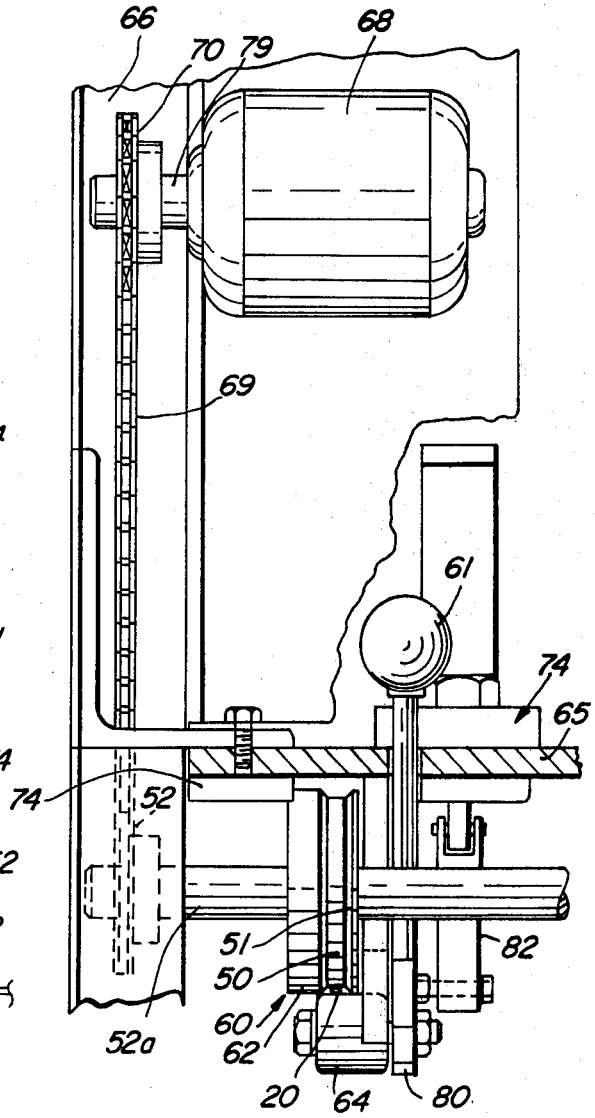
FIG. 4 is a sectional front perspective view of the power feed assembly of FIG. 3.

Details of the power feed assembly can best be seen in FIGS. 3 and 4. Means for guiding and engaging the bale tie wire 21 include first and second crown wheels 62 and 63 respectively, and idler wheel 64. Each crown wheel 62 and 63 has a middle surface 50 extending around the circumference of each wheel and two outer ridges 51 projecting radially outward from the outer edges of the middle surface 50. The idler wheel is interposed between the two crown wheels 62 and 63 in cooperating relationship with the crown wheels to define a path for a bale tie wire 21. The crown wheels 62 and 63 are coupled to a power source, motor 68 by means of a sprocket 70 attached to the motor shaft 74*a* and sprockets 52*a* and 53*b* secured to shaft 52*a* and 53*b* of crown wheels 62 and 63.

Idler wheel 64 is rotatably attached to an idler arm 80 which is in turn rotatably attached to power feed assembly frame 74 by means of bolt 81. An upward force is exerted on idler arm 80 by means of spring 77 in the solenoid activated air cylinder 76 attached to idler arm 80 by means of cylinder coupling 82. Lever 61 allows an operator to easily rotate idler arm 80 downward to facilitate loading a bale tie wire 21 in an engaging position with crown wheel 62 and 63. This feature is particularly important in loading bale tie wires 21 with preformed looped ends 21 as shown in FIG. 3. Solenoid activated air valve 76 is coupled to a compressed air source (not shown). When activated, pressure forces piston 76*b* upward exerting a further upward force on idler wheel 64 which in turn forces bale tie wire 21 firmly against the crown wheels 62 and 63. The additional force exerted upon the idler wheel 64 by the air cylinder 76 forces tie wire 21 more firmly against crown wheels 62 and 63 preventing slippage of the bale tie wire 21 as it is forced through the platen channels 18*a* and 18*b* and through the return chute assembly 30. Preferably, the solenoid activated air cylinder is activated simultaneously with motor 68.

Referring now to FIG. 5, the baling apparatus 11 is shown with a return chute assembly 30 having a plurality of chutes 36*a–f* and a corresponding number of power feed assemblies 60*a–f*. The plurality of power feed assemblies allow an operator to initially engage a tie wire 21 in each power feed assembly 60*a–f* as shown in FIG. 3. Preferably, in loading, the bale tie wire extends beyond the second crown wheel 63 but not into the press assembly 19 to avoid moving platen 17*a* and bale material (not shown). Preferably, all power feed assemblies 60*a–f* include means for remote simultaneous activation of the motor 68 and solenoid activated air valve 76, such that all bale tie wires 21 are fed into and through the upper channels 18*a* of the upper platen 17*a*, through the return chute assembly 30 and into and through the lower channel 18*b* of the lower platen 17*b* simultaneously.

The motor 68 and solenoid operated air cylinder 76 are deactivated when the bale tie wires 21 protrude from the lower channels 18*b*. Bale tie wire 21 still remaining in the power feed assembly 60 is released by depressing lever 61 lowering idler arm 80 and disengaging idler wheel 64 from bale tie wire 21. The end of the bale tie wire 21 yet protruding from the upper channel 18*a* and the end of the bale tie wire now extending from the lower channel 18*b* are manually joined and tied by a single press operator.

The use of bale tie wire 21 having a looped end 21*a* greatly facilitates the operation of the bale forming apparatus 11. As shown in FIG. 3, the looped end 21*a* of bale tie wire 21 presents a curved surface which deflects the bale tie wire over the pressed resilient material forming the bale and deflects over surface irregularities and obstructions within the return chute assembly 30 and channels 18*a* and 18*b* of the platens 17*a* and 17*b* rather than spearing or jamming.

Referring now to FIG. 5, in operation, a press operator will thread a plurality of bale tie wires 21 into the power feed assembly 60. The bale tie wires 21 leading edge is threaded between crown wheels 62 and 63 and idler wheel 64. Lever handle 61 is pulled forward and downward to depress idler arm 80 on pivot 81 to lower idler wheel 64 to allow bale tie wire 21 to be inserted. Spring 77 within the solenoid activated air cylinder 76 provides sufficient upward pressure to hold bale tie wire 21 in place until the air cylinder 76 is activated.

The press operator energizes the motor 68 as soon as the bale is pressed between platens 17*a* and 17*b*. Solenoid activated air cylinder 76 is connected in parallel to the motor 68 and is energized simultaneously to provide more force on the idler wheel 64, forcing bale tie wire 21 to be firmly engaged by crown wheels 62 and 63. Bale tie wires 21 are fed over the bale through upper channel 18*a* of platen 17*a*, through each chute 36 of the return chute assembly 30, and into and through the bottom channel 18*b* of the lower platen to once again emerge in the front of the baling apparatus 11. The operator deactivates motors 68 and the solenoid activated air cylinders 76 to cease the movement of the bale tie wires 21 and to reduce the force of the bale tie wire exerted by the idler wheel 64. The bale tie wire 21 is removed by depressing the lever handle 61 which disengages idler wheel 64 from the bale tie wire 21. The ends of the bale tie wire 21 are manually joined to secure the bale.

From the foregoing, it will be seen that the present invention provides a safe and efficient means for forming bales of resilient materials. While the perferred embodiment of the invention has been illustrated and described, it is understood that this is capable of variation and modification, and therefore the present invention should not be limited to the precise details set forth, but should include changes and alterations as fall within the purview of the following claims.

I claim:

1. A baling apparatus for use with bale strapping material including in combination:

a first press means and a second press means, each of said press means including a plurality of channel means extending across said press means;

a return chute assembly having a frame, a plurality of chute means, each chute means supported on said frame in juxtaposition to said first and second press means, said chute means having a curved face and two sidewalls, said curved face extending radially outward from said first and second press means, said sidewalls extending radially inward from the outer edges of said curved face, said chute means adapted to be aligned in communication with respective channel means of said first and second press means to slideably receive bale strapping material extending from said channel means of one of said press means and directing said strapping material along said curved face into and through said channel means of said opposite press means where the bale strapping material can be secured onto itself; and at least one frame member extending parallel to said first and second press means, said frame member including support means for receiving said chute means and including a releasable securing means affixing each of said chute means to said frame member, allowing for movement of said chute means along the length of said frame member to facilitate alignment of said chute means with said channels.

2. The apparatus of claim 1 further comprising at least one power feed assembly, said power feed assembly including:

a feed assembly frame;

a guide means supported by said feed assembly frame in juxtaposition to said press means opposite said return chute assembly, said guide means adopted to be aligned in communication with one of said first and second press means; and engagement means supported by said feed assembly frame in juxtaposition to said press means opposite said return chute assembly and adopted to engage said bale strapping material, said engagement means including a power source to move the bale strapping material as it is directed by said guide means into said aligned channel means of one of said press means, into and through said return chute assembly and through said channel means to said other press means where the bale strapping material can be secured onto itself.

3. The apparatus of claim 2 wherein said engagement means and guide means include wheel means and idler means, said wheel means including a middle surface, and two outer ridges, said middle surface extending about the circumference of said wheel means and said two outer ridges projecting radially outwardly from the outer edges of said middle surface, said idler means mounted in cooperating relationship with said wheel means to define a path for said strapping material, said wheel means coupled to said power source to allow said idler means and wheel means to engage and provide locomotion to said strapping material.

4. The apparatus of claim 3 further comprising an idler arm rotatably mounted to said power feed assembly frame, said idler arm supporting said idler means, said idler arm is movable from a first position to a second position, idler means in said first position cooperates with said wheel means to define a path for the strapping material, idler means in said second position is positioned closer to said wheel means to provide greater engagement force on the strapping material to facilitate the forced movement of the strapping material through said chute assembly.

5. A baling apparatus for use with bale strapping material including in combination:

a first press means and a second press means, each of said press means including at least one channel means extending across said press means;

a return chute assembly having a frame, at least one chute means supported on said frame in juxtaposition to said first and second press means, said chute means having a curved face and two sidewalls, said curved face extending radially outward from said first and second press means, said sidewalls extending radially inward from the outer edges of said curved face, said chute means adapted to be aligned in communication with said channel means of said first and second press means to slideably receive bale strapping material extending from said channel means of one of said press means and directing said strapping material along said curved face into and through said channel means of said opposite press means where the bale strapping material can be secured onto itself; and at least one power feed assembly, said power feed assembly including:

a feed assembly frame;

a guide means supported by said feed assembly frame in juxtaposition to said press means opposite said return chute assembly, said guide means adapted to be aligned in communication with one of said first and second press means; and engagement means supported by said feed assembly frame in juxtaposition to said press means opposite said return chute assembly and adopted to engage said bale strapping material, said engagement means including a power source to move the bale strapping material as it is directed by said guide means into said aligned channel means of one of said press means, into and through said return chute assembly and through said channel means to said other press means where the bale strapping material can be secured onto itself;

said engagement means and guide means include:

wheel means having a middle surface, and two outer ridges, said middle surface extending about the circumference of said wheel means and said two outer ridges projecting radially outwardly from the outer edges of said middle surface;

idler means mounted in cooperating relationship with said wheel means to define a path for said strapping material, said wheel means coupled to said power source to allow said idler means and wheel means to engage and provide locomotion to said strapping material;

an idler arm rotatably mounted to said power feed assembly frame, said idler arm supporting said idler means and movable from a first position to a second position, idler means in said first position cooperating with said wheel means to define a path for the strapping material, idler means in said second position positioned closer to said wheel means to provide greater engagement force on the strapping material to faciliate the forced movement of the strapping material through said chute assembly; and, an idler arm power means, said idler arm power means coupled to said idler arm and actuable simultaneously with said power source driving said wheel means to move said idler arm from said first position to said second position.

6. The apparatus of claim 5 wherein each press means includes a plurality of channel means and said return chute assembly includes a plurality of chute means, further comprising a plurality of power feed assemblies;

each of said chute means and each of said power feed assembly arranged in cooperation with said channel means, said power source driving each of said wheel means and each idler arm power means are actuable simultaneously to allow the simultaneous movement of a plurality of units of strapping material through each of said channel means of one of said press means, through each of said chute means, and through each of said channel means of said other press means where each unit of strapping material can be secured onto itself.

7. A bale threading apparatus for use with bale strapping material and a first press means and a second press means each press means including a plurality of channel means extending fore-and-aft across said press means, comprising:

a frame;

a plurality of chute means each chute means supported on said frame in juxtaposition to said first and second press means, said chute means having a curved face and two sidewalls, said curved face extending radially outward from said first and second press means, said sidewalls extending radially inward from the outer edges of said curved face, said chute means adapted to be aligned in communication with said channel means of said first and second press means to slideably receive bale strapping material extending from said channel means of one of said press means and directing the strapping material along said curved face into and through said channel means of said opposite press means where the bale strapping material can be secured unto itself; said frame including at least one frame member extending parallel to said first and second press means, said frame member including support means for receiving said chute means and including a releasable securing means affixing each of said chute means to said frame member, allowing for movement of said chute means along the length of said frame member to facilitate alignment of said chute means with said channels;

a power feed assembly including:

wheel means rotatably affixed to said feed assembly frame having a middle surface, and two outer ridges, said middle surface extending about the circumference of said wheel means and said two outer ridges projecting radially outwardly from the outer edges of said middle surface;

idler means mounted in cooperating relationship with said wheel means to define a path for said strapping material in communication with a channel means;

a power source coupled to said wheel means to allow said idler means and wheel means to engage and provide locomotion to said strapping material;

an idler arm rotatably mounted to said power feed assembly frame, said idler arm supporting said idler means and movable from a first position to a second position, idler means in said first position cooperating with said wheel means to define a path for the strapping material, idler means in said second position positioned closer to said wheel means to provide greater engagement force on the strapping material to facilitate the forced movement of the strapping material through said chute assembly; and, an idler arm power means, said idler arm power means coupled to said idler arm and actuable simultaneously with said power source driving said wheel means to move said idler arm from said first position to said second position.

8. The apparatus of claim 7 for use with said first and second press means each having a plurality of channel means, further comprising a plurality of power feed assemblies and a plurality of chute means;

each chute means and each power feed assembly arranged in cooperation with said channel means, said power source driving each of said wheel means and each idler arm power means are actuable simultaneously to allow the simultaneous movement of a plurality of units of strapping material through each of said channel means of one of said press means, through each of said chute means, and through each of said channel means of said other press means where each unit of strapping material can be secured onto itself.

* * * * *

UNITED STATES PATENT AND TRADEMARK OFFICE

CERTIFICATE OF CORRECTION

PATENT NO. : 4,438,689

DATED : March 27, 1984

INVENTOR(S) : Emil Simich

It is certified that error appears in the above-identified patent and that said Letters Patent is hereby corrected as shown below:

Column 4, line 38: change "tire" to --tie--.

Signed and Sealed this

*Sixteenth* Day of *October 1984*

[SEAL]

*Attest:*

GERALD J. MOSSINGHOFF

*Attesting Officer*

*Commissioner of Patents and Trademarks*